US009593503B2

(12) United States Patent
Creagh

(10) Patent No.: US 9,593,503 B2
(45) Date of Patent: Mar. 14, 2017

(54) PORTABLE EXPANDABLE CARPORT

(71) Applicant: William Lester Creagh, Fairfield, AL (US)

(72) Inventor: William Lester Creagh, Fairfield, AL (US)

( * ) Notice: Subject to any disclaimer, the term of this patent is extended or adjusted under 35 U.S.C. 154(b) by 0 days.

(21) Appl. No.: 15/083,708

(22) Filed: Mar. 29, 2016

(65) Prior Publication Data

US 2016/0289989 A1 Oct. 6, 2016

Related U.S. Application Data

(60) Provisional application No. 62/140,128, filed on Mar. 30, 2015.

(51) Int. Cl.
*E04H 6/04* (2006.01)
*E04H 6/02* (2006.01)

(52) U.S. Cl.
CPC ..... *E04H 6/04* (2013.01); *E04H 6/025* (2013.01)

(58) Field of Classification Search
CPC E04H 6/04; E04H 6/025; E04H 15/44; E04H 15/34; E04H 15/54; E04H 15/50; E04H 15/64
USPC .... 52/79.6, 90.1, 92.2; 135/88.08, 121, 122, 135/128, 157, 158, 160, 139, 145, 151; 114/361.363
See application file for complete search history.

(56) References Cited

U.S. PATENT DOCUMENTS 1,347,107 A * 7/1920 McCann ..... E04H 15/46 135/140
1,407,135 A * 2/1922 Ebbs ..... E04H 15/46 135/114
2,130,919 A * 9/1938 Erickson ..... E04H 15/46 135/118
2,723,673 A * 11/1955 Call ..... E04H 15/46 135/140
3,924,364 A * 12/1975 Eerkens ..... E04H 15/22 52/2.17
5,255,698 A * 10/1993 Riley ..... E04H 15/34 135/142
5,505,515 A * 4/1996 Turner ..... B60P 3/341 135/88.01
5,638,851 A * 6/1997 Baldwin ..... E04H 15/36 135/116

(Continued)

FOREIGN PATENT DOCUMENTS

CH GB 2430207 A * 3/2007 ..... E04H 6/025

*Primary Examiner* — Beth Stephan
(74) *Attorney, Agent, or Firm* — Dunlap Bennett & Ludwig PLLC

(57) ABSTRACT

An expandable and compressible carport is provided. The carport includes vertical supports adjustable in height and trusses adjustable in width. A first vertical support is adjustable in height by way of an inner tube telescoping with an outer tube. A first truss is coupled to a top end of the first vertical support and includes an adjustable width by way of an inner tube telescoping with an outer tube. The present invention further includes a second vertical support that is adjustable in height by way of an inner tube telescoping with an outer tube. A second truss is coupled to a top end of the second vertical support and includes an adjustable width by way of an inner tube telescoping with an outer tube. A ridge board connects the first truss and the second truss together.

11 Claims, 5 Drawing Sheets

(56) References Cited

U.S. PATENT DOCUMENTS

| | | | | |
|---|---|---|---|---|
| 5,711,337 | A * | 1/1998 | McKenney | E04H 15/34 135/120.4 |
| 6,131,749 | A * | 10/2000 | Crockett | B60R 7/10 211/105.3 |
| 6,223,358 | B1 * | 5/2001 | DePietro | A63B 61/003 248/157 |
| 7,814,723 | B2 * | 10/2010 | VanElverdinghe | E04C 3/07 135/122 |
| 8,056,573 | B2 * | 11/2011 | Panigot | E04H 15/48 135/144 |
| 2005/0194031 | A1 * | 9/2005 | Goldwitz | E04H 15/44 135/128 |
| 2005/0252542 | A1 * | 11/2005 | Basta | E04H 15/34 135/156 |
| 2007/0144425 | A1 * | 6/2007 | Buckley | B63B 17/02 114/361 |
| 2007/0295379 | A1 * | 12/2007 | Basta | B63C 5/00 135/122 |
| 2012/0085380 | A1 * | 4/2012 | Buckley | E04H 15/46 135/140 |
| 2016/0222692 | A1 * | 8/2016 | Maillis | E04H 15/46 135/139 |

* cited by examiner

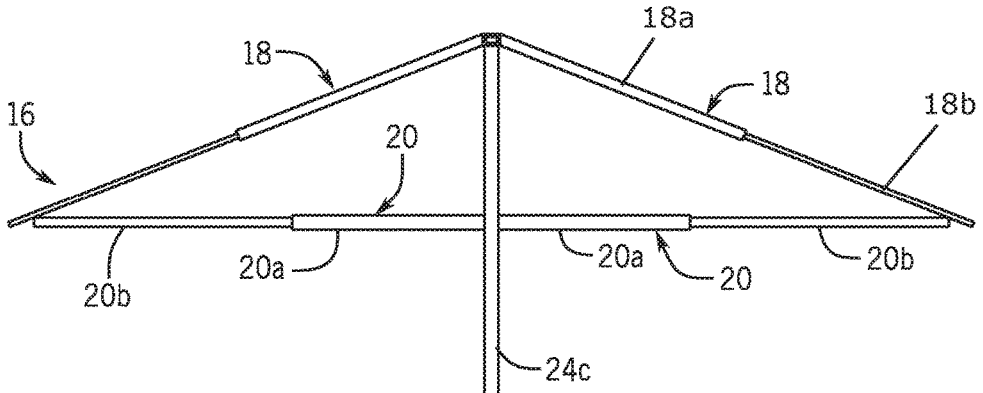
18a
18
18
18b
16
20
20b
20a
20a
20
20b
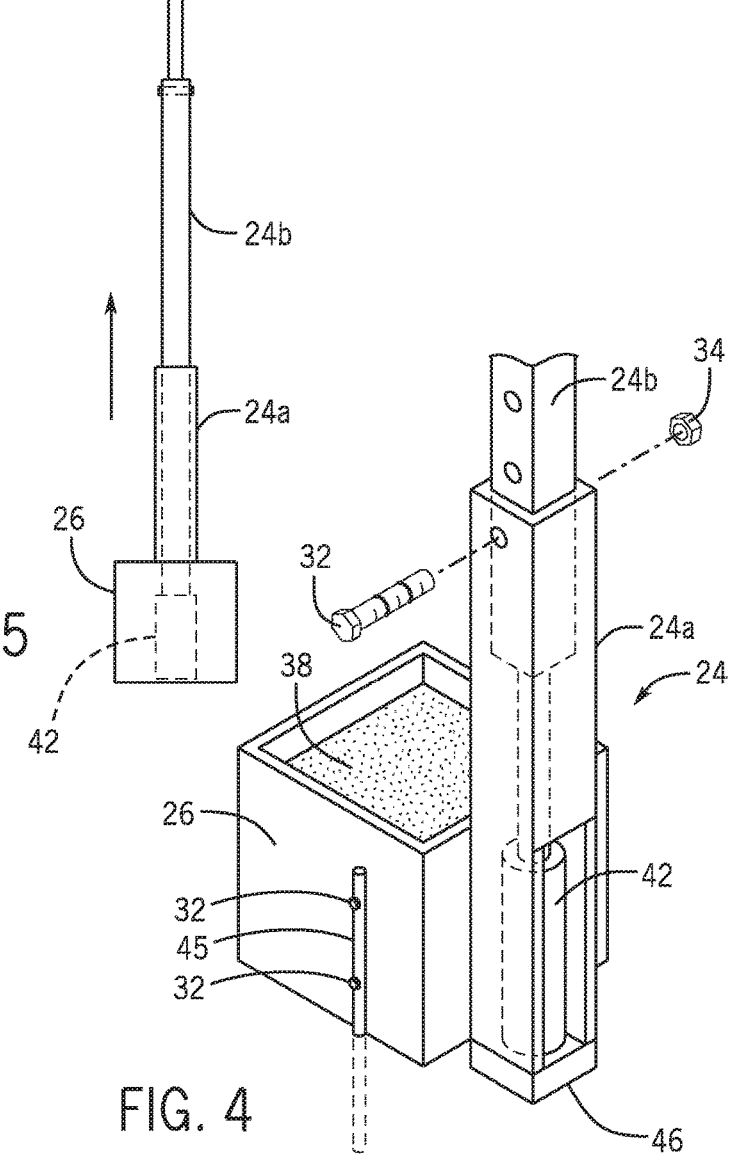
24c
24b
24a
26
42
FIG. 5
34
24b
32
24a
24
38
26
42
32
45
32
46
FIG. 4

PORTABLE EXPANDABLE CARPORT

CROSS-REFERENCE TO RELATED APPLICATION

This application claims the benefit of priority of U.S. provisional application No. 62/140,128, filed Mar. 30, 2015, the contents of which are herein incorporated by reference.

BACKGROUND OF THE INVENTION

The present invention relates to a carport and, more particularly, to a compressible and expandable carport.

A carport is a covered structure used to offer limited protection to vehicles from the elements. The structure can either be free standing or attached to a wall. Unlike most structures a carport does not have four walls, and usually has one or two. Carports offer less protection than garages but allow for more ventilation. Cars, trucks and vans greatly vary in size and shape. Current carports are not adjustable. Therefore, if one purchases a new car, truck, or van, the carport may have to be re-constructed which requires a lot of time and effort.

As can be seen, there is a need for a carport that may easily adjust in size and shape.

SUMMARY OF THE INVENTION

In one aspect of the present invention, an expandable and compressible carport comprises: a first vertical support comprising an adjustable height by way of an inner tube telescoping with an outer tube; a first truss coupled to a top end of the first vertical support, wherein the first truss comprises at least one rafter comprising an adjustable width by way of an inner tube telescoping with an outer tube; a second vertical support comprising an adjustable height via an inner tube telescoping with an outer tube; a second truss coupled to a top end of the second vertical support, wherein the second truss comprises at least one rafter comprising an adjustable width by way of an inner tube telescoping with an outer tube; and a ridge board connecting the first truss and the second truss together.

These and other features, aspects and advantages of the present invention will become better understood with reference to the following drawings, description and claims.

BRIEF DESCRIPTION OF THE DRAWINGS

FIG. 4 is a detail perspective view of an embodiment of the present invention;

FIG. 5 is a front elevation view of an embodiment of the present invention;

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

The present invention includes a versatile expandable and compressible carport. The present invention may be easily expanded and compressed to adjust to the car in which the carport is housing. The present invention protects vehicles from the elements of nature such as rain, hail, snow, and debris from strong winds. In alternate embodiments, the present invention may be used as patio cover, storage space and the like. The present invention is also easy to assemble and disassemble in order to move to another location.

Figure 1:
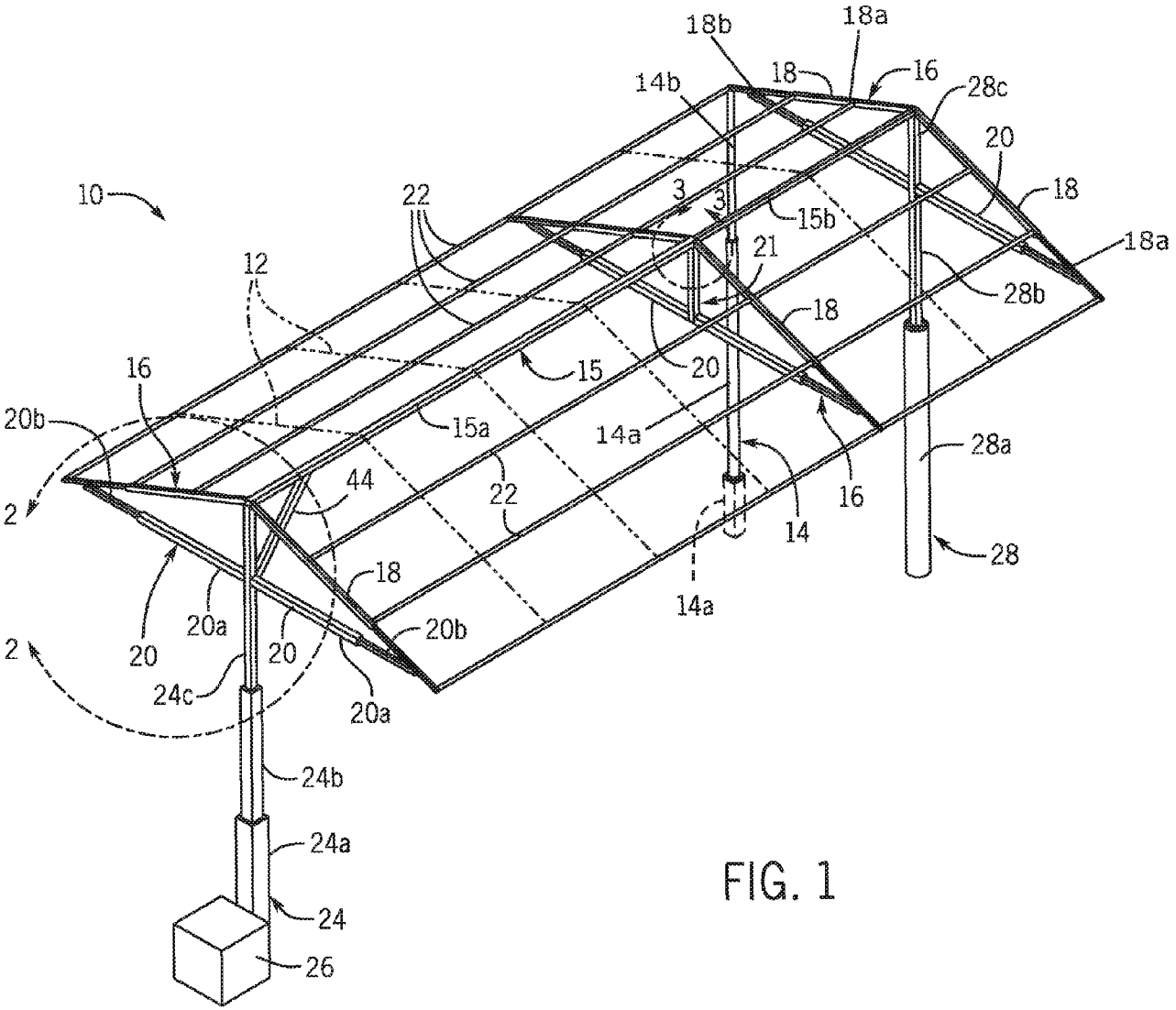
FIG. 1 is a front perspective view of an embodiment of the present invention.
Figure 2:
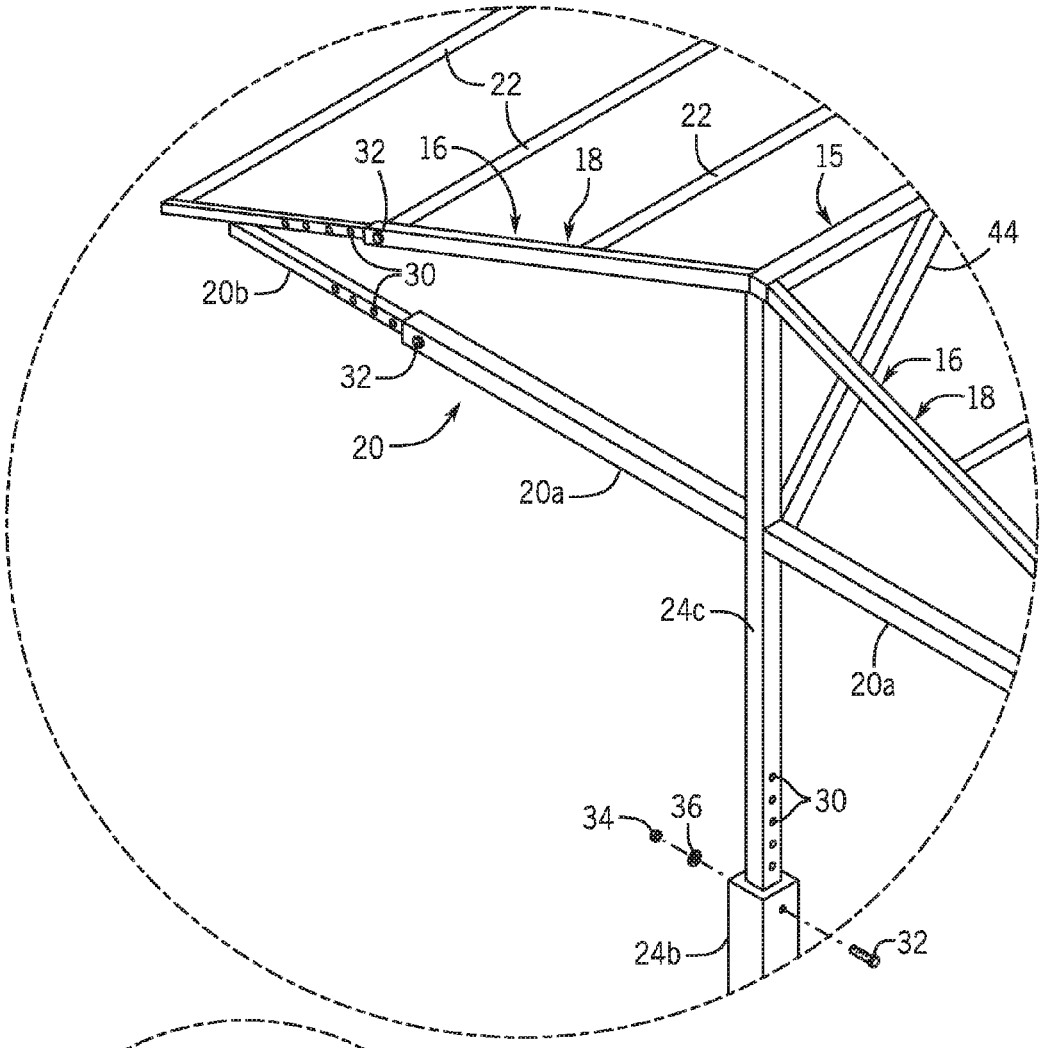
FIG. 2 is a detail perspective view of the present invention taken along 2-2 in FIG. 1.
Figure 3:
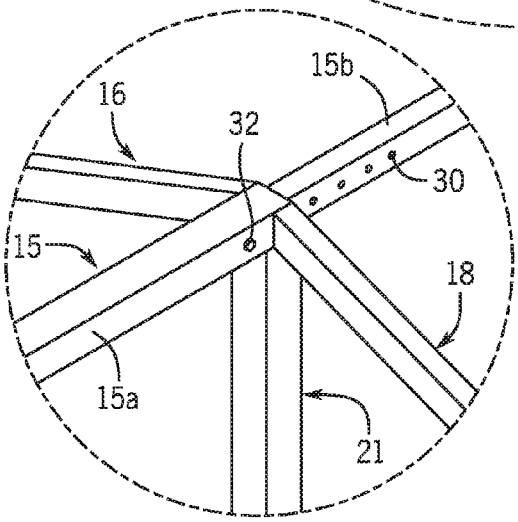
FIG. 3 is a detail perspective view of the present invention taken along 3-3 in FIG. 1.
Figure 6:
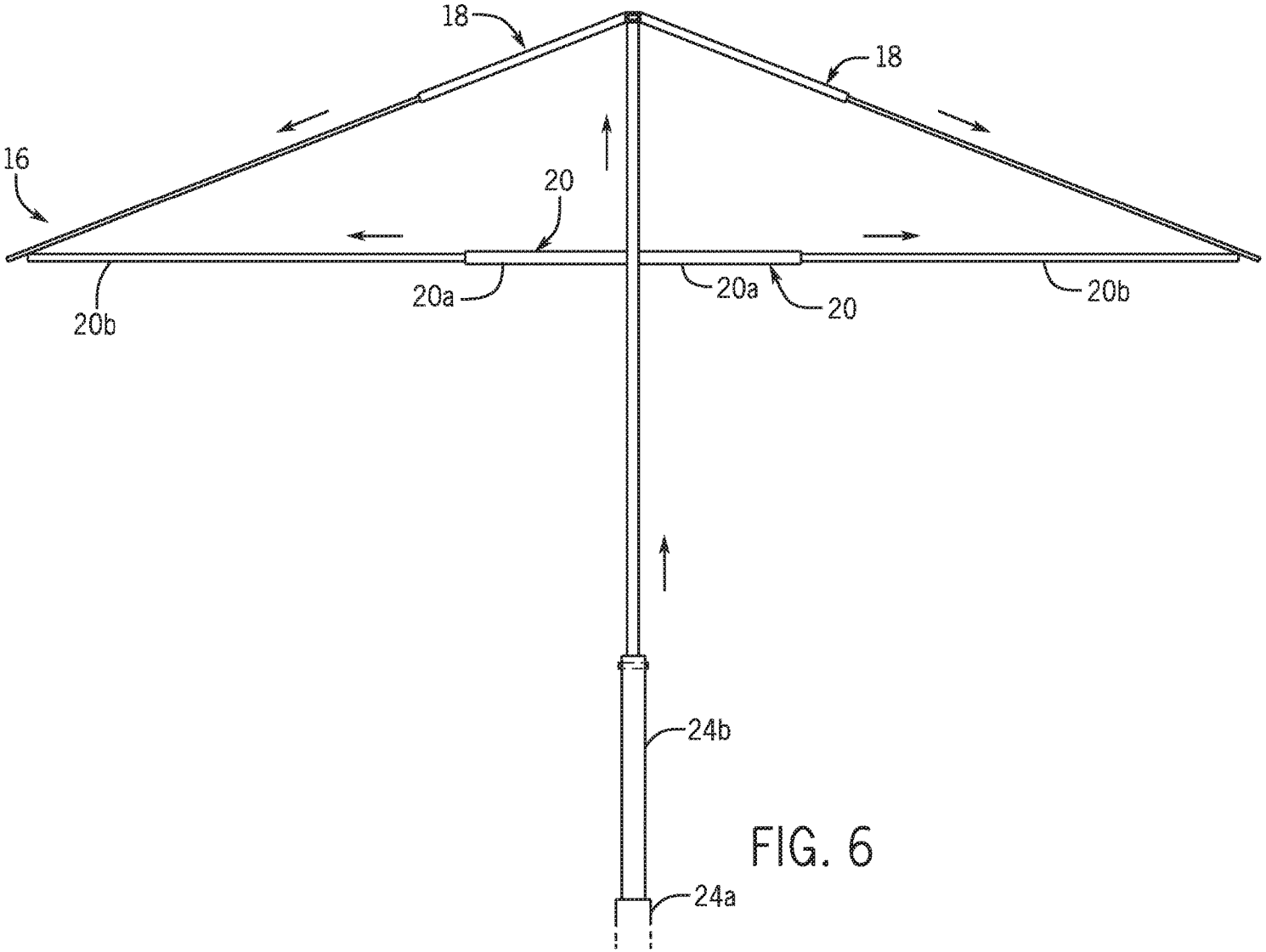
FIG. 6 is a front elevation view showing an expansion of the height and width of an embodiment of the present invention.
Figure 7:
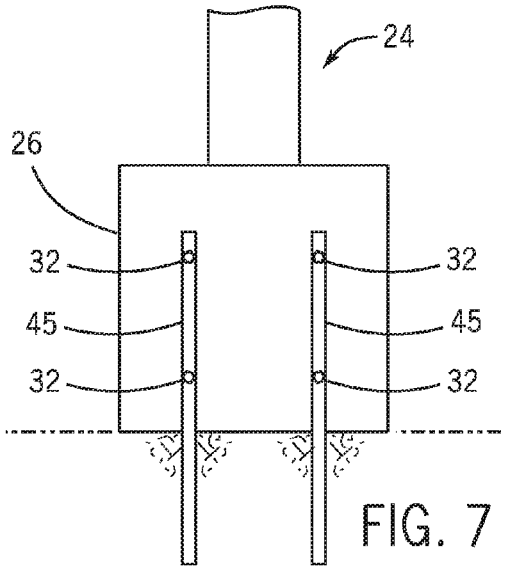
FIG. 7 is a rear elevation view of a weighted block of an embodiment of the present invention.
Figure 8:
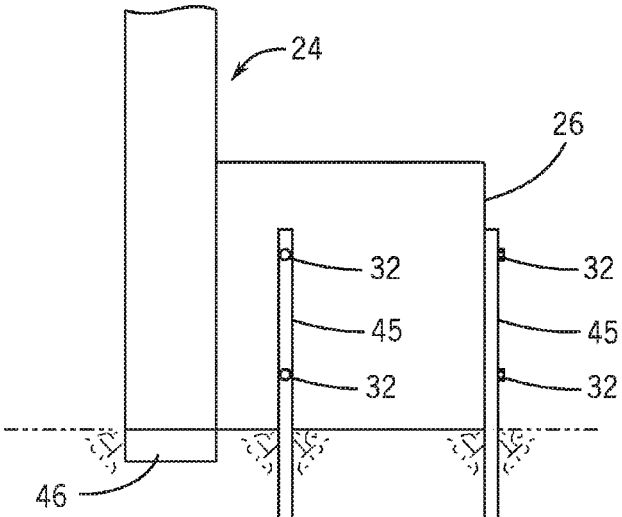
FIG. 8 is a right side elevation view of a weighted block of an embodiment of the present invention.
Figure 9:
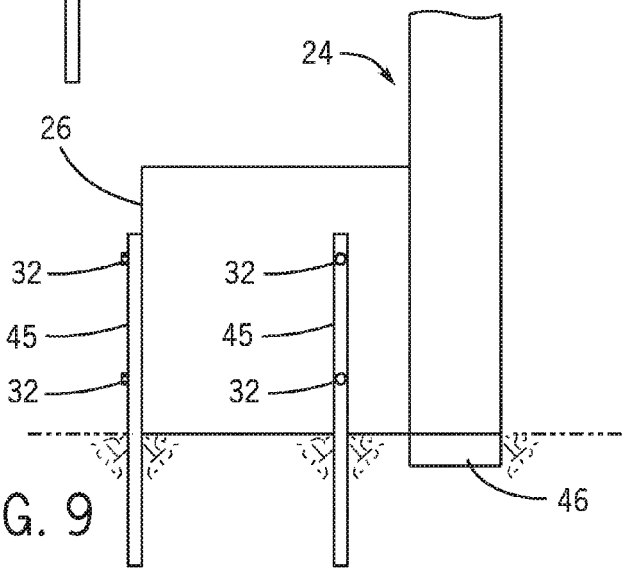
FIG. 9 is a left side elevation view of a weighted block of an embodiment of the present invention.

Referring to FIGS. 1 through 9, the present invention includes an expandable and compressible carport 10. The carport 10 includes vertical supports 14, 24, 28 adjustable in height and trusses 16 adjustable in width. In certain embodiments, the present invention includes a first vertical support 24 that is adjustable in height by way of an inner tube 24*c* telescoping with an outer tube 24*b*. A first truss 16 is coupled to a top end of the first vertical support 24 and includes an adjustable width by way of an inner tube 18*b* telescoping with an outer tube 18*a*. The present invention further includes a second vertical support 28 that is adjustable in height by way of an inner tube 28*b* telescoping with an outer tube 28*a*. A second truss 16 is coupled to a top end of the second vertical support 28 and includes an adjustable width by way of an inner tube 18*b* telescoping with an outer tube 18*a*. A ridge board 15 connects the first truss 16 and the second truss 16 together.

In certain embodiments, the present invention may further include a third truss 16. The third truss 16 is secured to the ridge board 15 in between the first truss 16 and the second truss 16. The third truss 16 may also include an adjustable width by way of an inner tube 18*b* telescoping with an outer tube 18*a*.

Each of the trusses 16 may include rafters 18, rafter ties 20 and a central vertical support 21. The rafter ties 20 may extend laterally from the central vertical support 21 and may be substantially horizontal. Each rafter tie 20 may include an outer tube 20*a* secured to a bottom end the central vertical support 21, and an inner tube 20*b* slidably engaged within the outer tube 20*a*. The rafters 18 may extend laterally from a top end of the central vertical support 21 towards the rafter ties 20. Each rafter 18 may include an outer tube 18*a* secured to the top end the central vertical support 21, and an inner tube 18*b* slidably engaged within the outer tube 20*a*. A distal end of the rafters 18 may connect with a distal end of the rafter ties 20. Therefore, the inner tubes 18*b*, 20*b* may extend in and out of the outer tubes 18*a*, 20*a* together, expanding and contracting the width of a roof of the carport 10. A support brace 44 may secure the central vertical support 21 to the ridge board 15 for additional support.

In certain embodiments, the ridge board 15 may be adjustable in length by way of an inner tube 15*b* telescoping with an outer tube 15*a*. In such embodiments, the outer tube 15*a* may connect the first truss 16 to the third truss 16. The inner tube 15*b* may include a first end slidably engaged within the outer tube 15*a*, and a second end secured to the second truss 16. Therefore, the second truss 16 can slide towards the third truss 16 in a compressed position and slide away from the third truss 16 in an expanded position, thereby adjusting the length of the roof of the carport 10.

The first vertical support 24 may include a base housing 24*a*, an outer tube 24*b* and an inner tube 24*c*. The outer tube 24*b* may fit within the base housing 24*a* and the inner tube 24*c* may fit within the outer tube 24*b*. A bottom portion 46 of the base housing 24*a* may be buried in the ground. The inner tube 24*c* may slide up in an expanded form and down in a compressed form, thereby adjusting the height of the carport 10. To further add support, the present invention may include a weighted block 26 having a dense material 38, such as rock or cement, within. The weighted block 26 may be secured to the base housing 24*a* and may be secured to the ground via stands 45 secured to the weighted block 26 via bolts 32. The stands 45 may be at least partially buried in the ground. In certain embodiments, the base housing 24*a* may secure a linear actuator 42 within, such as a hydraulic jack, which may aid in transforming the present invention from a compressed form to an expanded form.

As mentioned above, a second vertical support 28 is adjustable in height by way of an inner tube 28*b* telescoping with an outer tube 28*a*. The inner tube 28*b* may slide up in an expanded form and down in a compressed form, thereby adjusting the height of the carport 10. As mentioned above, the second truss 16 is coupled to the second vertical support 28. In certain embodiments, a third vertical support 14 may also support the second truss 16. The third vertical support 14 may include an adjustable height via an inner tube 14*c* telescoping with an outer tube 14*b*. A top end of the third vertical support 14 is coupled to a distal end of the second truss 16. A bottom portion 14*a* of the third vertical support 14 may be at least partially buried in the ground.

To adjust the inner tubes relative to the outer tubes, each of the inner tubes may include a plurality of apertures 30 and each of the outer tubes may include at least one aperture 30. The inner tube and the outer tube may be adjusted so that the at least one aperture of the outer tube aligns with one of the plurality of apertures 30 of the inner tube. A bolt 32 may run through the aligned apertures 30 and a nut 34 and washer 36 may secure to a threaded end of the bolt 32, thereby fixing the inner tube and the outer tube together. To further adjust the inner tube and the outer tube, the bolt 32 may be removed and the tubes may be adjusted relative to one another.

The present invention may further include a plurality of purlins 22 that are secured to the carport 10 in between the trusses 16. For example, the purlins 22 may be secured to the rafters 18. Once the proper length, height and width of the carport 10 is determined, the outer tubes and inner tubes are adjusted accordingly. The purlins 22 are then secured in between the trusses 16. The roof panels 12 are then secured to the purlins 22 to construct a finished carport 10.

It should be understood, of course, that the foregoing relates to exemplary embodiments of the invention and that modifications may be made without departing from the spirit and scope of the invention as set forth in the following claims.

What is claimed is:

1. An expandable and compressible carport comprising:

a first vertical support comprising an adjustable height by way of an inner tube telescoping with an outer tube;

a first truss coupled to a top end of the first vertical support, wherein the first truss comprises at least one rafter comprising an adjustable width by way of an inner tube telescoping with an outer tube;

a second vertical support comprising an adjustable height via an inner tube telescoping with an outer tube;

a second truss coupled to a top end of the second vertical support, wherein the second truss comprises at least one rafter comprising an adjustable width by way of an inner tube telescoping with an outer tube; and a ridge board comprising an adjustable length by way of an inner tube telescoping with an outer tube, wherein the ridge board connects the first truss and the second truss together such that a distance between the first and the second truss is adjustable by way of the ridge board.

2. The carport of claim 1, wherein each of the first truss and the second truss further comprise at least one rafter tie secured to the at least one rafter by a central support, wherein the at least one rafter tie comprises an adjustable width by way of an inner tube telescoping with an outer tube.

3. The carport of claim 1, further comprising a third truss secured to the ridge board in between the first truss and the second truss, wherein the third truss comprises at least one rafter comprising an adjustable width by way of an inner tube telescoping with an outer tube.

4. The carport of claim 1, further comprising a third vertical support comprising an adjustable height via an inner tube telescoping with an outer tube, wherein a top end of the third vertical support is coupled to a distal end of the second truss.

5. The carport of claim 4, wherein a bottom portion of the third vertical support is buried in a ground.

6. The carport of claim 1, further comprising a plurality of purlins releasably secured to the rafters forming a roof.

7. The carport of claim 1, further comprising a weighted block secured to a bottom end of the first vertical support.

8. The carport of claim 1, further comprising a linear actuator operably connected to at least one of the first vertical support and the second vertical support.

9. The carport of claim 1, wherein the inner tubes and the outer tubes are adjustable by way of a plurality of apertures formed through one of the inner tubes and the outer tubes and at least one aperture formed through the other of the inner tubes and the outer tubes, wherein a pin is sized to fit through aligned apertures of the inner tubes and the outer tubes.

10. An expandable and compressible carport comprising:

a first vertical support comprising an adjustable height by way of an inner tube telescoping with an outer tube;

a first truss coupled to a top end of the first vertical support, wherein the first truss comprises at least one first rafter extending from the top end of the first vertical support and comprising an adjustable width by way of an inner tube telescoping with an outer tube and at least one first rafter tie extending between the at least one first rafter and the first vertical support and comprising an adjustable width by way of an inner tube telescoping with an outer tube;

a second vertical support comprising an adjustable height via an inner tube telescoping with an outer tube;

a second truss coupled to a top end of the second vertical support, wherein the second truss comprises at least one second rafter extending from the top end of the second vertical support and comprising an adjustable width by way of an inner tube telescoping with an outer tube and at least one second rafter tie extending between the at least one second rafter and the second vertical support and comprising an adjustable width by way of an inner tube telescoping with an outer tube; and a ridge board connecting the first truss and the second truss together at the top ends of the first and the second vertical supports.

11. An expandable and compressible carport comprising:

a first vertical support comprising an adjustable height by way of an inner tube telescoping with an outer tube;

a first truss coupled to a top end of the first vertical support, wherein the first truss comprises at least one rafter comprising an adjustable width by way of an inner tube telescoping with an outer tube;

a second vertical support comprising an adjustable height via an inner tube telescoping with an outer tube;

a second truss coupled to a top end of the second vertical support, wherein the second truss comprises at least one rafter comprising an adjustable width by way of an inner tube telescoping with an outer tube;

a ridge board connecting the first truss and the second truss together; and a plurality of purlins releasably secured to the rafters forming a roof.

* * * * *